US006055691A

United States Patent [19]

Nützel et al.

[11] Patent Number: 6,055,691

[45] Date of Patent: May 2, 2000

[54] METHOD OF MOUNTING AND TENSIONING A FREELY TENSIONED TENSION MEMBER AND DEVICE FOR CARRYING OUT THE METHOD

[75] Inventors: Oswald Nützel, Munich; Dieter Jungwirth, Bad Heilbrunn; Lorenz Schnitzler, Pöcking, all of Germany

[73] Assignee: Dyckerhoff & Widmann Aktiengesellschaft, Munich, Germany

[21] Appl. No.: 09/124,885

[22] Filed: Jul. 30, 1998

[30] Foreign Application Priority Data

Aug. 5, 1997 [DE] Germany ..... 197 33 822

[51] Int. Cl.[7] ..... E01D 11/04

[52] U.S. Cl. ..... 14/22; 29/452; 254/29

[58] Field of Search ..... 29/452, 446, 238, 29/458, 426.4; 254/29; 81/9, 4

[56] References Cited

U.S. PATENT DOCUMENTS

| | | | |
|---|---|---|---|
| Re. 30,342 | 7/1980 | Perrino | 81/9.5 B |
| 1,273,713 | 7/1918 | Aaron . | |
| 3,597,830 | 8/1971 | Yegge | 29/452 |
| 3,710,433 | 1/1973 | Brandestini | 29/452 |
| 3,755,880 | 9/1973 | Simms | 29/452 |
| 4,053,974 | 10/1977 | Howlett et al. | 29/452 |
| 4,473,936 | 10/1984 | Kellner et al. | 29/458 |
| 4,715,106 | 12/1987 | Peterson | 29/426.4 |

FOREIGN PATENT DOCUMENTS 3437108 9/1988 Germany .

*Primary Examiner*—Eileen Dunn Lillis
*Assistant Examiner*—Raymond W Addie
*Attorney, Agent, or Firm*—Friedrich Kueffner

[57] ABSTRACT

A method of mounting and tensioning a freely tensioned tension member, particularly a stay cable for a cable-stayed bridge, and a device for carrying out the method, wherein the polyethylene casing of each individual strand is removed during the tensioning process over the length of the extension distance occurring during tensioning at the tensioning end. The peeling tool of the device for carrying out the method is composed of a sleeve having at one end thereof at least one cutting edge, wherein the sleeve surrounds the respective strand over at least an essential portion of the circumference thereof. The sleeve can be positioned in a stationary manner between the anchoring disk and the tensioning press, wherein the strand is pulled through the sleeve during the tensioning process.

15 Claims, 2 Drawing Sheets

Fig. 3
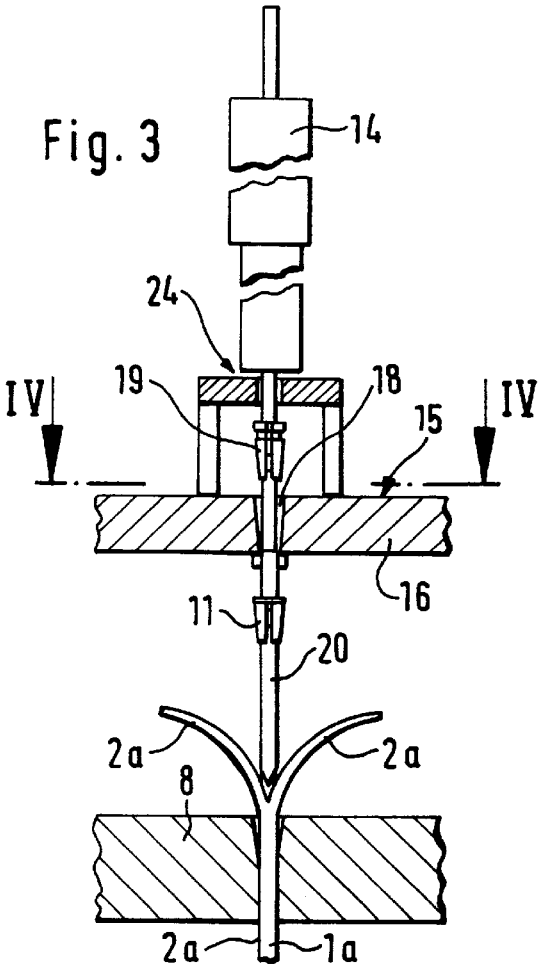
Fig. 5
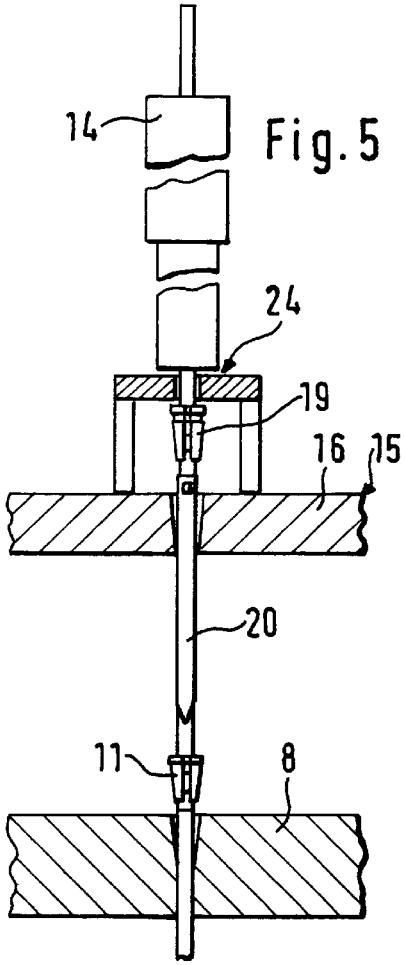
Fig. 4
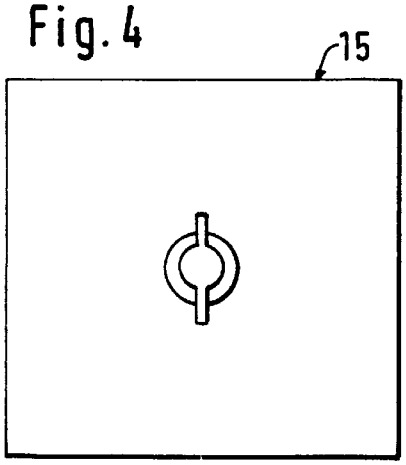
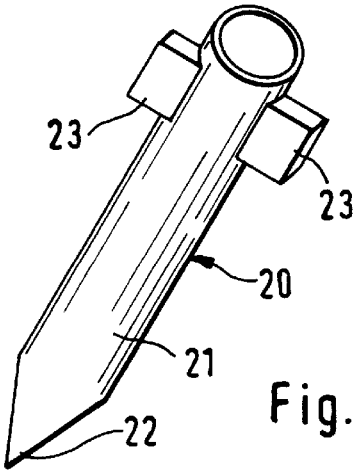
Fig. 6

METHOD OF MOUNTING AND TENSIONING A FREELY TENSIONED TENSION MEMBER AND DEVICE FOR CARRYING OUT THE METHOD

BACKGROUND OF THE INVENTION

1. Field of the Invention

The present invention relates to a method of mounting and tensioning a freely tensioned tension member, particularly a stay cable for a cable-stayed bridge, and a device for carrying out the method.

2. Description of the Related Art

Tension members are frequently used in civil engineering for anchoring structural components; such tension members are, for example, stay cables for cable-stayed bridges or the like and are frequently composed of a bundle of individual elements, such as steel wires or steel strands. Along the free length of the tension member, the individual elements are arranged together in a tubular sheathing; for anchoring the tension members they are longitudinally movably guided through the respective structural components and are anchored at the side of the respective structural component located opposite the entry point of the individual element. The anchoring systems include an anchoring disk with bores through which the individual elements are passed and relative to which they are anchored, for example, by means of multipart annular wedges. Along the free length of the tension member, the tubular sheathing may be a plastic pipe, for example, of polyethylene, or a steel pipe. In the anchoring range, the sheathing tube usually is an anchoring pipe of steel. If the individual elements themselves are protected against corrosion, the hollow space between the individual elements and the tubular sheathing may remain unfilled or, after tensioning of the individual elements, a corrosion protection substance, for example, grease, or a hardening material, for example, cement mortar, may be pressed into the hollow space.

Particularly in stay cables of cable-stayed bridges, a problem is posed by the fact that the heavy cables must be mounted in the required inclined position between the anchoring systems for the cables in the girder supporting the roadway and at the top of the tower, frequently at great heights. There are several methods for assembling the stay cables on the work plane, for example, on the floor plate of the already finished bridge portion and for raising the stay cables by means of appropriate lifting apparatus into the required inclined position, or for producing an inclined template on scaffolding for the assembly of the stay cables and threading the individual elements placed on the template into the sheathing pipe. Finally, it is also known in the art to join the individual elements freely tensioned to form a bundle and to mount the tubular sheathing only subsequently. In each case, the individual elements must be threaded into the lower and upper anchoring systems before they can be tensioned.

In order to avoid the weight resulting from filling out the hollow space between the individual elements and the tubular sheathing with a corrosion protection material, the individual elements used for such tension members frequently are strands of steel wire which are covered with a layer of grease as corrosion protection and are surrounded by a casing of polyethylene. While such strands encased with polyethylene can be used as tension members in the same manner as bare strands, it is necessary to remove this polyethylene casing in the area of the anchoring systems, so that the wedges used for anchoring can act directly on the strands. For reasons of corrosion protection, it is especially important in the case of tension members in which the hollow space in the anchoring area remains unfilled to remove the polyethylene casing from the strand in such a way that in the final state, i.e., when the strand is tensioned, the remaining polyethylene casing ends as close as possible to the respective anchoring wedges independently of tolerances in cutting to length and of construction inaccuracies.

SUMMARY OF THE INVENTION

Therefore, it is the primary object of the present invention to provide a possibility for achieving the goal of having as short a distance as possible at the end of the polyethylene casing from the anchoring wedges in the position of use of the tension member with as uncomplicated means as possible and with the greatest certainty possible, while simultaneously from the outset excluding tolerances, measuring errors or the like.

In accordance with the present invention, the polyethylene casing of each individual strand is removed during the tensioning process over the length of the extension distance occurring during tensioning at the tensioning end.

The peeling tool for carrying out the method is composed of a sleeve having at one end thereof at least one cutting edge, wherein the sleeve surrounds the respective strand over at least an essential portion of the circumference thereof. The sleeve can be positioned in a stationary manner between the anchoring disk and the tensioning press, wherein the strand is pulled through the sleeve during the tensioning process.

Accordingly, the basic concept of the present invention resides in removing the polyethylene casing only during the tensioning process; specifically, the casing is removed simultaneously with tensioning of the respective strand over the length of the extension or elongation distance occurring during tensioning at the tensioning end. This eliminates any geometrical uncertainties which may occur when the polyethylene casing is removed already prior to mounting the strand.

For carrying out the method according to the present invention, a peeling tool for acting on the polyethylene casing of the strand is arranged at the tensioning end of the strand, i.e., at the point where the tensioning press is applied for tensioning and the extension distance occurs. In the simplest case, the peeling tool may be a knife or the like which is used for cutting a slit in the polyethylene casing during a tensioning intermission.

In accordance with a particularly advantageous feature, the peeling tool is composed of a tool held in a stationary manner, which, during the elongation of the strand occurring as a result of tensioning, peels the casing or cuts a slit in the casing at least in the longitudinal direction, so that, after making a simple transverse cut, the casing can be completely separated from the strand and removed.

In this connection, the present invention partially utilizes the teaching of DE 34 37 108 C2 which relates to a device and method for assembling a tension member of the above-described type. For mounting and later tensioning the individual elements of a stay cable, a tensioning chair is used with an intermediate anchoring plate located in front of the anchoring disk and supported relative to the structural component by means of a support structure. This plate has bores for passing the individual elements therethrough and for effecting an intermediate anchoring of the individual elements, wherein the intermediate anchoring continues on the side of the plate facing the anchoring disk in a pipe piece attached to the plate, wherein an annular wedge each can be pushed onto the pipe piece so as to resiliently widen the piece.

Such a tensioning chair makes it possible to pull each strand through an annular wedge or to push each strand through the annular wedge, without there being the danger that the strands or the coatings thereof are damaged by the teeth of the wedges or the wedges are even pulled prematurely into the conical bore which would block the strands prematurely.

In accordance with another feature of the present invention, a tensioning chair can be used for tensioning the strands relative to which the peeling tools are braced. In order to ensure that the polyethylene casing can be removed as closely as possible to the wedge, the cutting edge of the peeling tool must reach as far as possible to the surface of the anchoring disk. In order to have the anchoring wedge which is used later already available during this manipulation, the anchoring wedge can be placed on the tubular peeling tool which is pulled back through the bore in the support plate of the tensioning chair after the peeling process of the strand has ended. This makes space available for making it possible to push the anchoring wedge from the peeling tool down onto the strand.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 3 is a schematic illustration of the tensioning and peeling process using a tensioning chair;

FIG. 4 is a top view of the chair plate taken along line IV—IV in FIG. 3;

FIG. 5 is a schematic illustration showing anchoring of a peeled strand by lowering the strand; and FIG. 6 is a perspective view of a peeling tool.

DESCRIPTION OF THE PREFERRED EMBODIMENTS

Figure 1:
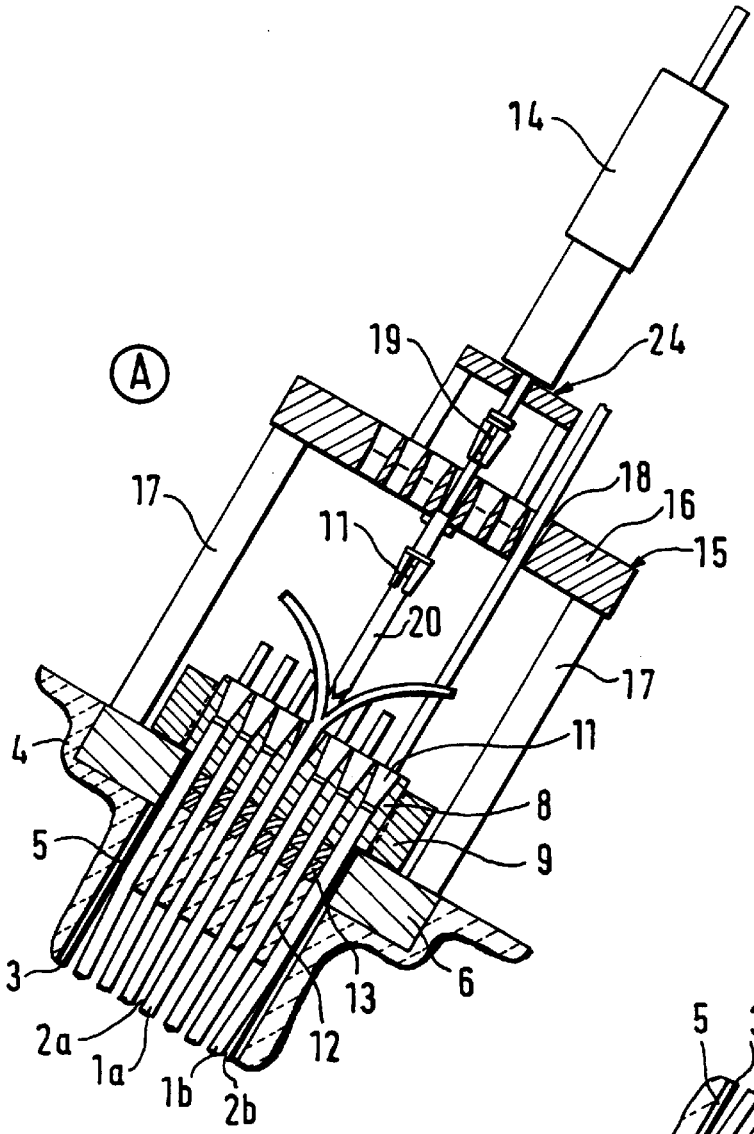
FIG. 1 is a schematic longitudinal sectional view showing the anchoring system of a stay cable on the tensioning side, for example, at the upper end of a tower.
Figure 2:
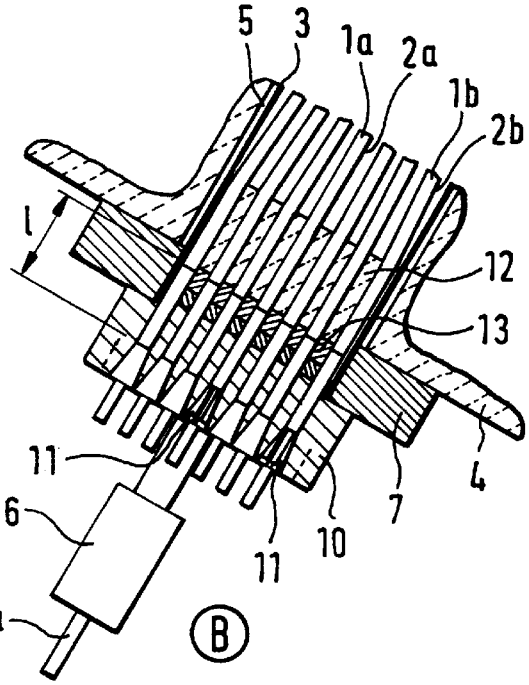
FIG. 2 is a view corresponding to FIG. 1, showing the anchoring system at the opposite anchoring side, for example, at the roadway girder.

The schematic illustrations of FIGS. 1 and 2 show the two end anchoring systems of a stay cable of a cable-stayed bridge, i.e., the anchoring system at the upper tensioning side A at the top of a tower and the anchoring system at the lower anchoring side B on the roadway girder. The stay cable is symbolically illustrated by two strands 1*a* and 1*b* which in practice are part of a bundle of a freely selectable number of strands. In accordance with the present invention, the strands 1*a*, 1*b* are high-strength steel wires which are galvanized, covered with grease and surrounded with polyethylene casings 2*a*, 2*b* each.

Along the free length of the stay cable between the anchoring systems A and B, not shown, the stay cable extends in a tubular sheathing, for example, a sheathing pipe of plastic material. In the anchoring areas A at the upper end and B at the lower end, the stay cable extends with an anchor pipe 3 which along the free length continues the tubular sheathing within a tensioning duct formed by a pipe 5 secured in the concrete of the structure 4 and is braced by an abutment plate 6 and 7, respectively. The support is effected at the tensioning side A shown in FIG. 1 by an anchoring disk 8 and an annular nut 9 surrounding the anchoring disk 8 and at the anchoring side B shown in FIG. 2 only by an anchoring disk 10. The strands 1*a* and 1*b* are anchored respectively by means of annular wedges 11 in the anchoring disks 8 and 10. Sealing members 12 and spacers 13 are additionally provided in the interior of the anchor pipe 3.

The process of mounting, tensioning and peeling the strands will now be explained in detail in connection with FIGS. 1 and 2, wherein the strands 1*a* and 1*b* are illustrated in different conditions of tensioning. If an aftertensioning is to be carried out later at the anchoring side B shown in FIG. 2, the casing is removed initially from the strands on this side to such an extent that after the assembly a free strand length 1 remains in front of the wedge 11. This is illustrated in connection with strand 1*a*. On the tensioning side A shown in FIG. 1, the casing is removed from the strands to such an extent that a tensioning press 14 can be placed and the polyethylene casing 2*a* ends after the insertion of the strand approximately at the surface of the anchoring disk 8. This is also illustrated in connection with strand 1*a*. These steps of removing the casing are carried out already prior to mounting of the strands; consequently, the lengths of the removed casings are the same for all strands. A tensioning chair 15 is then mounted on the tensioning side A. The tensioning chair 15 is composed of a chair plate 16 extending parallel to and at a distance from the anchoring disk 8, wherein the chair plate 16 is supported by means of supports 17 relative to the abutment plate 6 and, thus, relative to the structure 4. As is the case in the anchoring disk 8, the chair plate 16 is provided with bores 18 into which additional annular wedges 19 can be placed.

After these preliminary steps, the strands are mounted individually. This mounting can be effected by a conventional method, for example, by shooting in or by pulling in.

As illustrated in connection with strand 1*a*, the wedge 11 is initially placed on the anchoring side B shown in FIG. 2; this is done is such a way that a free strand length 1 remains in front of the wedge. Subsequently, preparations are made for peeling the polyethylene casing at the other end. In the illustrated embodiment, in the area of the tensioning chair 15 on the tensioning side A shown in FIG. 1, a tubular peeling knife 20 is placed on the portion of the strand 1*a* from which the casing of the strand has been removed and the annular wedge 11 intended for later anchoring of the strand is pushed onto the tubular peeling knife 20, so that the annular wedge 11 is widened. This situation is shown on a larger scale in FIG. 3.

A peeling knife 20 used for this purpose is illustrated in a perspective view in FIG. 6. The peeling knife 20 has a tubular portion 21 with at least one cutting edge 22 at the lower end thereof and with lateral projections 23 at the upper end for supporting the peeling knife 20 in a bayonet-type locking manner relative to the chair plate 16.

Finally, the tensioning press 14 for tensioning the strand 1*a* is placed on the tensioning chair 15. In accordance with a useful feature, the tensioning press 14 is supported on the tensioning chair 15 by means of a small second tensioning chair 24, so that the strand can be intermediately anchored by means of wedges 19 relative to the chair plate 16 in the case of longer tensioning distances which require several tensioning steps. This second tensioning chair 24 provides the possibility of being able to hold back the temporary wedge 19 for a later lowering of the strand 1*a*.

During the tensioning process, the strand 1*a* including the polyethylene casing 2*a* are pulled through the surrounding peeling knife 20 and through the bore 25 in the anchoring disk 8. During this process, the cutting edge 22 of the peeling knife 20 acting on the open end of the polyethylene casing 2*a* cuts a slit in the polyethylene casing 2*a* up to the anchoring disk 8 and the casing 2*a* is peeled off. A transverse cut which is necessary for completely removing the polyethylene casing 2*a* can be carried out subsequently. The strand 1*a* is easily accessible for this process because, as seen in cross-section, the strand bundle is built up in layers from the bottom toward the top. In order to be able to cut the polyethylene casing of a strand as reliably as possible, the peeling knife 20 is advantageously constructed in such a way that it rotates in accordance with the turn of the strand wires as the wires are pulled through. However, for this purpose, the peeling knife must be rotatable under compressive load about its axis; at least its lower portion containing the cutting edge must be rotatable relative to its upper portion which is used for supporting the peeling knife.

Instead of using a peeling knife 20, the casing can also be removed manually from the strand la during the tensioning process. In that case, the wedge 11 is positioned on a small tube which surrounds the strand 1*a* and is attached to the bottom side of the chair plate 16.

After the necessary tensioning force has been reached, the permanent wedge 11 is pushed on the tensioning side A onto the strand up to the end of the polyethylene casing. This situation is illustrated in FIG. 5. In order to be able to push the wedge 11 downwardly from the peeling knife 20 onto the strand 1*a*, the peeling knife 20 must first be separated from its support relative to the chair plate 1G and must be pulled back through the bore 18. In this situation, the temporary wedge 19 is held back and the pressure in the tensioning press 14 is lowered until the permanent wedge 11 is anchored in the anchoring disk 8. This situation is illustrated in connection with strand 1*b* in FIG. 1.

As a result of lowering the pressure in the tensioning press 14, a loss of tensioning force occurs in the strand. For compensating this loss, an aftertensioning step is carried out on the anchoring side B in the area of the length 1 where the casing has been removed; this situation is illustrated in connection with strand 1*a* in FIG. 2. Because the extension distance can be expected to be small, a tensioning press 26 having a short structural length can be used at this location. The tensioning distance should be predetermined as precisely as possible in order to have the wedge as closely as possible against the end of the polyethylene casing 2*b* in the final state. The length l for removing the casing can also be predetermined in a specifically targeted manner in order to have an extension possibility later for any necessary corrections.

The final situation is illustrated in connection with strand 1*b* on the tensioning side A shown in FIG. 1 as well as on the anchoring side B shown in FIG. 2.

Instead of aftertensioning the strand on the anchoring side B, it is also possible to overtension the strand on the tensioning side A beyond the statically required tensioning force in order to be able to remove the polyethylene casing at least along the length of the wedge. Subsequently, the tensioning force is lowered and the wedge is placed at the tensioning force determined by computation.

While specific embodiments of the invention have been shown and described in detail to illustrate the inventive principles, it will be understood that the invention may be embodied otherwise without departing from such principles.

We claim:

1. A method of mounting and tensioning a freely tensioned tension member, particularly a stay cable for a cable-stayed bridge, the tension member being composed of a bundle of individual strands of steel wires, each strand having a polyethylene casing, the strands having first and second ends anchored by wedges in an anchoring disk each supported relative to a structure, wherein the polyethylene casings of the strands are each removed in an area of the anchoring ends, the method comprising:

positioning a peeling tool having at one end thereof at least one cutting edge at each strand;

tensioning the strand by a length of an extension distance and simultaneously removing the polyethylene casing of each individual strand by substantially longitudinally cutting the polyethylene casing by the cutting edge over the length of the extension distance.

2. The method according to claim 1, wherein the reeling tool is stationary at least during the tensioning process, further comprising peeling the polyethylene casing by the peeling tool as a result of a longitudinal displacement of the polyethylene casing occurring during tensioning of the strand at one of the ends of the strand.

3. The method according to claim 1, comprising anchoring each strand initially at the first end thereof, wherein subsequently the strand is tensioned at the second end thereof and the polyethylene casing is removed up to a surface of the anchoring disk, and subsequently anchoring the strand at the second end by lowering a tensioning force.

4. The method according to claim 3, comprising aftertensioning the strand at the first end thereof by a distance corresponding to a release distance occurring during anchoring at the second end.

5. The method according to claim 3, comprising removing the polyethylene casing of the strand at the first end prior to mounting the strand by a length which makes possible a later aftertensioning at the first end by a corresponding length.

6. The method according to claim 3, comprising overtensioning the strand by a release distance at the first end occurring when anchoring is carried out at the second end.

7. A device for mounting and tensioning a freely tensioned tension member, particularly a stay cable for a cable-stayed bridge, the tension member being comprised of a bundle of individual strands of steel wires having a polyethylene casing, the strands having ends anchored by wedges in anchoring disks supported relative to a structure, wherein the polyethylene casing of each strand is removed in an area of an end of each strand, the device comprising:

a peeling tool having at one end thereof at least one cutting edge, the peeling tool being comprised of a sleeve surrounding each strand over at least a substantial portion of a circumference thereof;

means for positioning the sleeve in a stationary manner between the anchoring disk and a tensioning press, wherein the sleeve is configured to have the strand pulled through the sleeve during a tensioning process of the strand, the tensioning process causing the strand to be extended by a length of an extension distance;

wherein the cutting edge is configured to cut substantially longitudinally the length of the extension distance of the polyethylene casing and peel the longitudinally cut length from the strand, as the strand is pulled through the sleeve during the tensioning process.

8. The device according to claim 7, wherein the peeling tool is comprised of a pipe which completely surrounds the strand.

9. The device according to claim 7, wherein the peeling tool comprises a cutting edge facing the strand.

10. The device according to claim 8, wherein the peeling tool has a stationary portion and a portion with the cutting edge, wherein the portion with the cutting edge is rotatable relative to the stationary portion.

11. The device according to claim 7, further comprising a tensioning chair supported relative to the structure, the tensioning chair having a chair plate located at a distance from the anchoring disk for supporting the tensioning press during the tensioning process, wherein the peeling tool is mounted between the anchoring plate and the chair plate and is braced relative to the chair plate.

12. The device according to claim 11, wherein the tensioning chair has a height, and wherein a length of the peeling tool is selected such that the cutting edge of the peeling tool is located approximately on a level of a surface of the anchoring plate.

13. The device according to claim 11, wherein the chair plate has bores configured as wedge seats for effecting an intermediate anchoring of the strands.

14. The device according to claim 13, wherein the peeling tool is configured to be insertable and removable through the bores in the chair plate.

15. The device according to claim 14, further comprising a bayonet-type lock for connecting the peeling tool to the chair plate.

* * * * *